US007473858B1

(12) United States Patent
Berndt et al.

(10) Patent No.: US 7,473,858 B1
(45) Date of Patent: Jan. 6, 2009

(54) MOVEMENT DETECTING DEVICE

(75) Inventors: Walter E. Berndt, Goshen, IN (US); David W. Miedema, Elkhart, IN (US)

(73) Assignee: Mercury Displacement Industries, Inc., Edwardsburg, MI (US)

( * ) Notice: Subject to any disclaimer, the term of this patent is extended or adjusted under 35 U.S.C. 154(b) by 0 days.

(21) Appl. No.: 11/943,740

(22) Filed: Nov. 21, 2007

Related U.S. Application Data

(60) Provisional application No. 60/868,248, filed on Dec. 1, 2006.

(51) Int. Cl.
*H01H 35/14* (2006.01)

(52) U.S. Cl. ..... 200/61.45 R; 200/61.52; 200/61.53

(58) Field of Classification Search ..... 200/61.45 R–61.53; 73/514.01, 514.16, 514.29, 514.35
See application file for complete search history.

(56) References Cited

U.S. PATENT DOCUMENTS

| | | | | | |
|---|---|---|---|---|---|
| 1,964,954 | A | | 7/1934 | Leins | |
| 3,733,447 | A | | 5/1973 | Scheider, Jr. | |
| 3,769,472 | A | * | 10/1973 | Bell et al. | 200/61.45 R |
| 3,818,160 | A | | 6/1974 | Hitchcock | |
| 3,886,339 | A | | 5/1975 | Jubenville et al. | |
| 4,022,998 | A | * | 5/1977 | Fohl | 200/61.45 R |
| 4,097,698 | A | * | 6/1978 | Jackman | 200/61.45 R |
| 4,144,422 | A | | 3/1979 | Ramos | |
| 4,185,507 | A | | 1/1980 | Domyan | |
| 4,425,488 | A | | 1/1984 | Moskin et al. | |
| 4,628,160 | A | | 12/1986 | Canevari | |
| 4,775,854 | A | | 10/1988 | Cottrell | |
| 5,136,126 | A | | 8/1992 | Blair | |
| 5,155,308 | A | | 10/1992 | Blair | |
| RE34,175 | E | * | 2/1993 | Grimes et al. | 200/84 R |
| 5,252,795 | A | | 10/1993 | Su | |
| 5,285,033 | A | | 2/1994 | Ipcinski | |
| 5,307,054 | A | * | 4/1994 | Concannon et al. | 340/690 |
| 5,332,992 | A | | 7/1994 | Woods | |
| 5,477,019 | A | * | 12/1995 | Dolling | 200/61.48 |
| 5,504,287 | A | * | 4/1996 | Cable | 200/61.52 |
| 5,543,767 | A | | 8/1996 | Elenbaas | |
| 5,602,429 | A | | 2/1997 | Scgiebelhuth | |
| 5,610,590 | A | | 3/1997 | Johnson et al. | |
| 5,639,999 | A | * | 6/1997 | Hsu | 200/61.52 |
| 5,672,856 | A | | 9/1997 | Kolb et al. | |
| 5,747,762 | A | | 5/1998 | Fukuda et al. | |
| 5,837,951 | A | * | 11/1998 | Kato et al. | 200/61.45 R |
| 6,005,205 | A | | 12/1999 | Chou | |
| 6,130,609 | A | * | 10/2000 | Huang | 340/467 |

(Continued)

FOREIGN PATENT DOCUMENTS

| | | |
|---|---|---|
| GB | 2 403 067 | 12/2004 |

*Primary Examiner*—Michael A Friedhofer
(74) *Attorney, Agent, or Firm*—Michael A. Myers; Botkin & Hall, LLP

(57) ABSTRACT

A movement detecting device detects movement, or tilt, of a building facilities component, and controls a desired event through an electrical signal without using mercury. The device includes a first housing section and a second housing section held together by a fastener. A ball is disposed between the first and second housing sections within a cavity. A mechanical switch is disposed between the first and second housing sections so that the switch extends into the cavity for contact with the ball when movement of the device exceeds a predetermined angle. A damper arm is included for securing the device to a facilities component to be monitored as desired.

11 Claims, 3 Drawing Sheets

U.S. PATENT DOCUMENTS

| | | | | |
|---|---|---|---|---|
| 6,198,059 | B1 | 3/2001 | Jou | |
| 6,448,516 | B1 | 9/2002 | Chiang | |
| 6,706,978 | B2 | 3/2004 | Wagatsuma et al. | |
| 6,917,004 | B1 * | 7/2005 | Engdahl | 200/61.45 R |
| 7,045,725 | B2 | 5/2006 | Gallagher et al. | |
| 2005/0104853 | A1 | 5/2005 | Sitalasai et al. | |
| 2006/0027447 | A1 | 2/2006 | Lo | |

* cited by examiner 10
100
30
18
14
36
16
12
29
33

16
16
12
18
24
13
26
28
22
23
20
15
14
32
34
31
30

MOVEMENT DETECTING DEVICE

REFERENCE TO RELATED APPLICATIONS

This application claims domestic priority based upon U.S. Provisional Application No. 60/868,248, filed Dec. 1, 2006, which is incorporated herein by reference.

TECHNICAL FIELD OF THE INVENTION

This invention relates generally to electrical switches and sensors and, more particularly, to a movement detecting device and switch useful in the building automation industry.

BACKGROUND OF THE INVENTION

Building automation involves the programming and utilization of a network of electronic and electromechanical devices that monitor and control the mechanical and electrical systems in a building to create an intelligent building and reduce energy and maintenance costs. Movement detecting devices are commonly used for this purpose. Such electrical switches and sensors have conventionally employed elemental mercury as a conductor or weight. In building automation, control of devices such as air handlers and water systems, for example, use a plurality of such switches and sensors to monitor and control building logistics. Since it is now known to be harmful to humans as well as the environment, however, it has become less desirable to use mercury. Additionally, there exist federal standards and regulations controlling the use of mercury in commerce.

It would therefore be advantageous to provide an electrical switch or sensor that can be utilized to detect movement, or tilt, of a building facilities component, and control a desired event through an electrical signal without using mercury in conjunction with such a sensor or switch. Further, the switch or sensor should be able to provide the same or substantially similar functionality as would be expected from a switch or sensor containing mercury.

SUMMARY OF THE INVENTION

The present invention relates to a movement detecting device that includes a first housing section and a second housing section. A ball is disposed between the first and second housing sections within a cavity. A switch is disposed between the first and second housing sections so that the switch extends into the cavity for contact with the ball.

The device may include a mounting apparatus for mounting the device to a mechanical device to be monitored as desired.

In one aspect, the switch may include a lever arm that extends from the switch into the cavity.

In another aspect, the mounting apparatus may include a damper arm having a slot in which resides a first exterior lip portion of the first housing section and a second exterior lip portion of the second housing section when the first and second housing sections are secured together.

One object of the present invention is to provide an improved movement detecting device, which device is capable of detecting movement, or tilt, of a building facilities component, and control a desired event through an electrical signal without using mercury. Related objects and advantages of the present invention will be apparent from the following description.

DESCRIPTION OF THE PREFERRED EMBODIMENT

Figure 1:
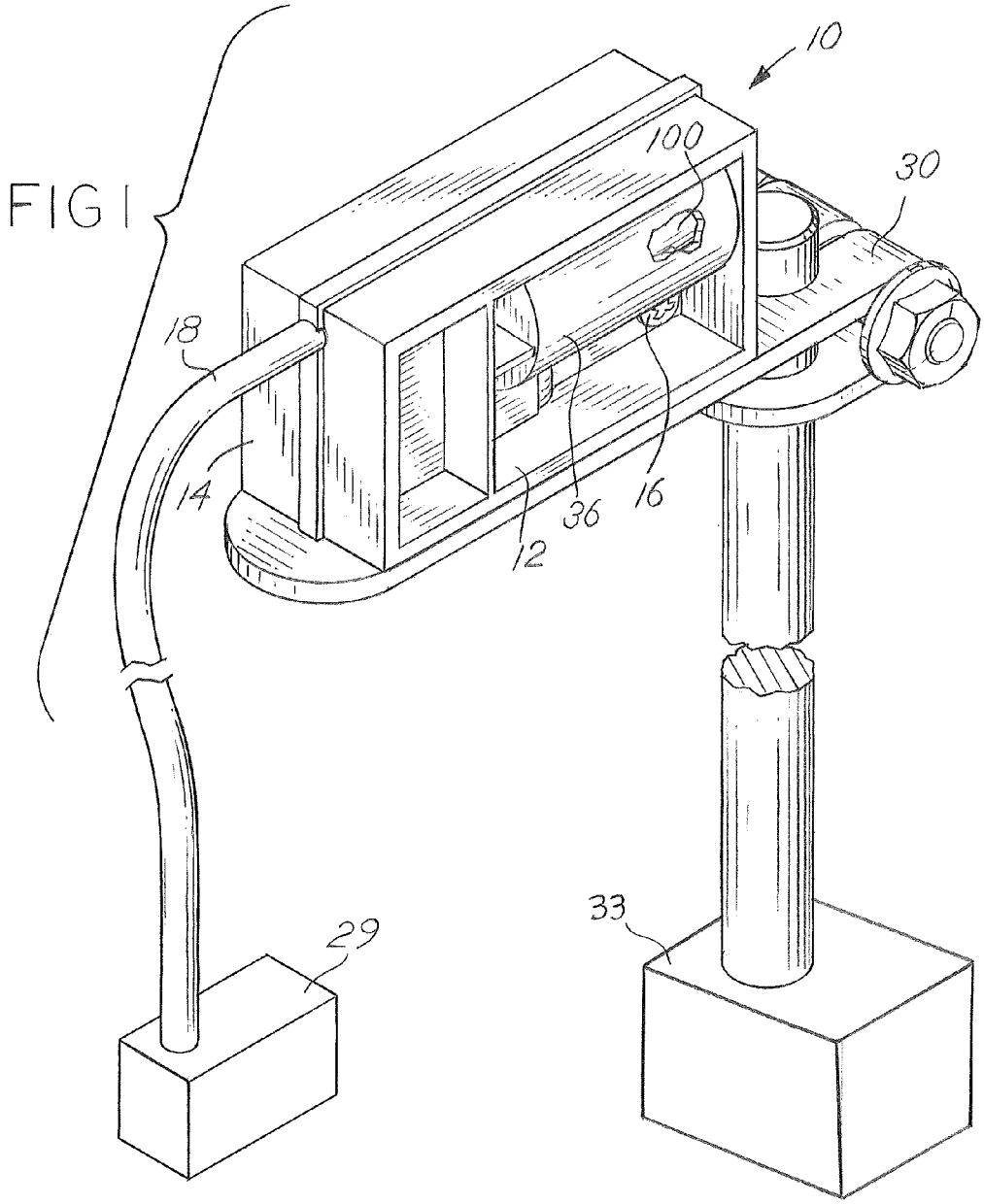
FIG. 1 is an elevated side perspective view of an embodiment of a movement detecting device and switch shown from the rear, according to the present invention.

For the purposes of promoting an understanding of the principles of the invention and presenting its currently understood best mode of operation, reference will now be made to the embodiments illustrated in the drawings and specific language will be used to describe the same. It will nevertheless be understood that no limitation of the scope of the invention is thereby intended, with such alterations and further modifications in the illustrated device and such further applications of the principles of the invention as illustrated therein being contemplated as would normally occur to one skilled in the art to which the invention relates.

Figure 2:
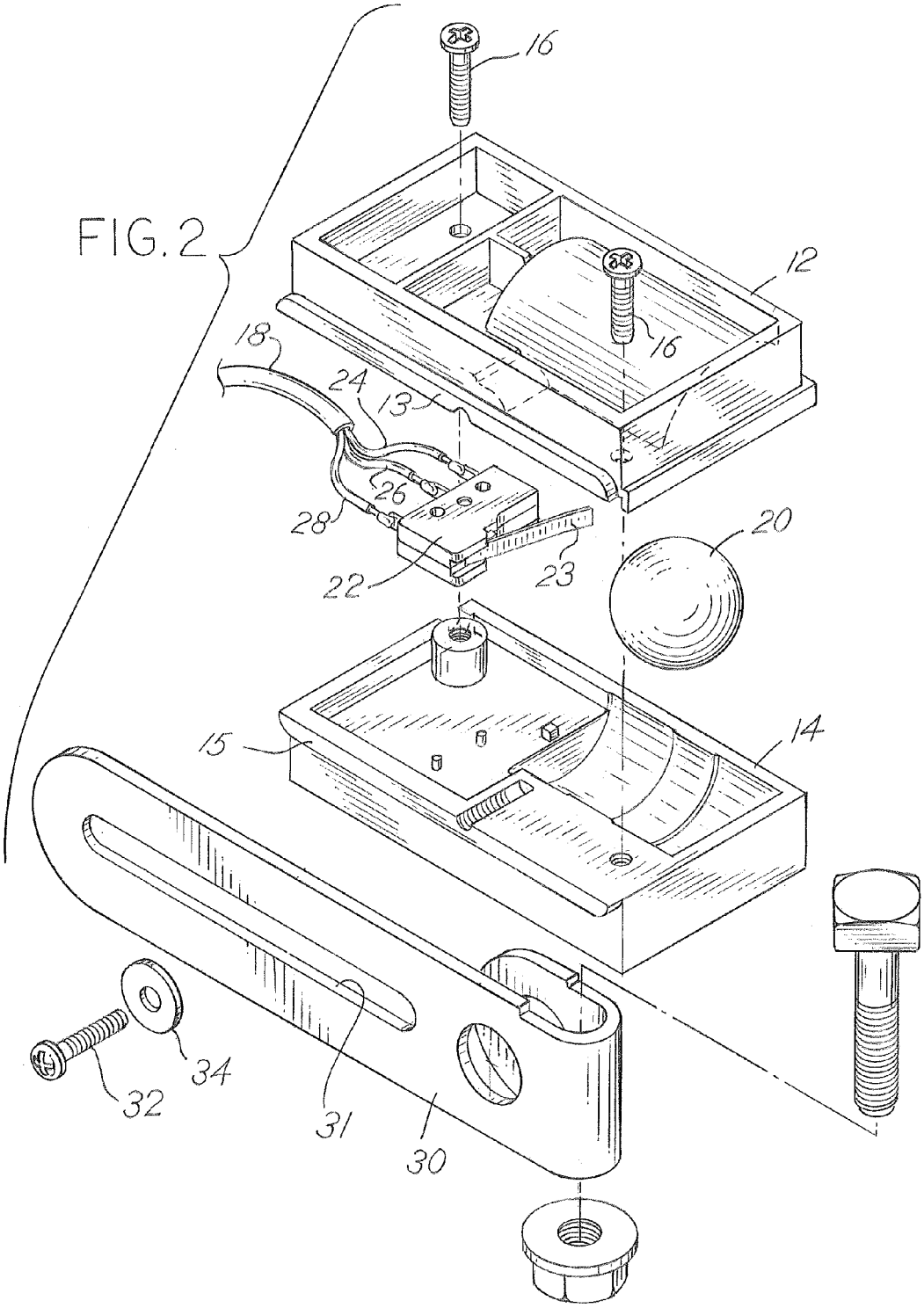
FIG. 2 is an exploded perspective view of the movement detecting device and switch.
Figure 3:
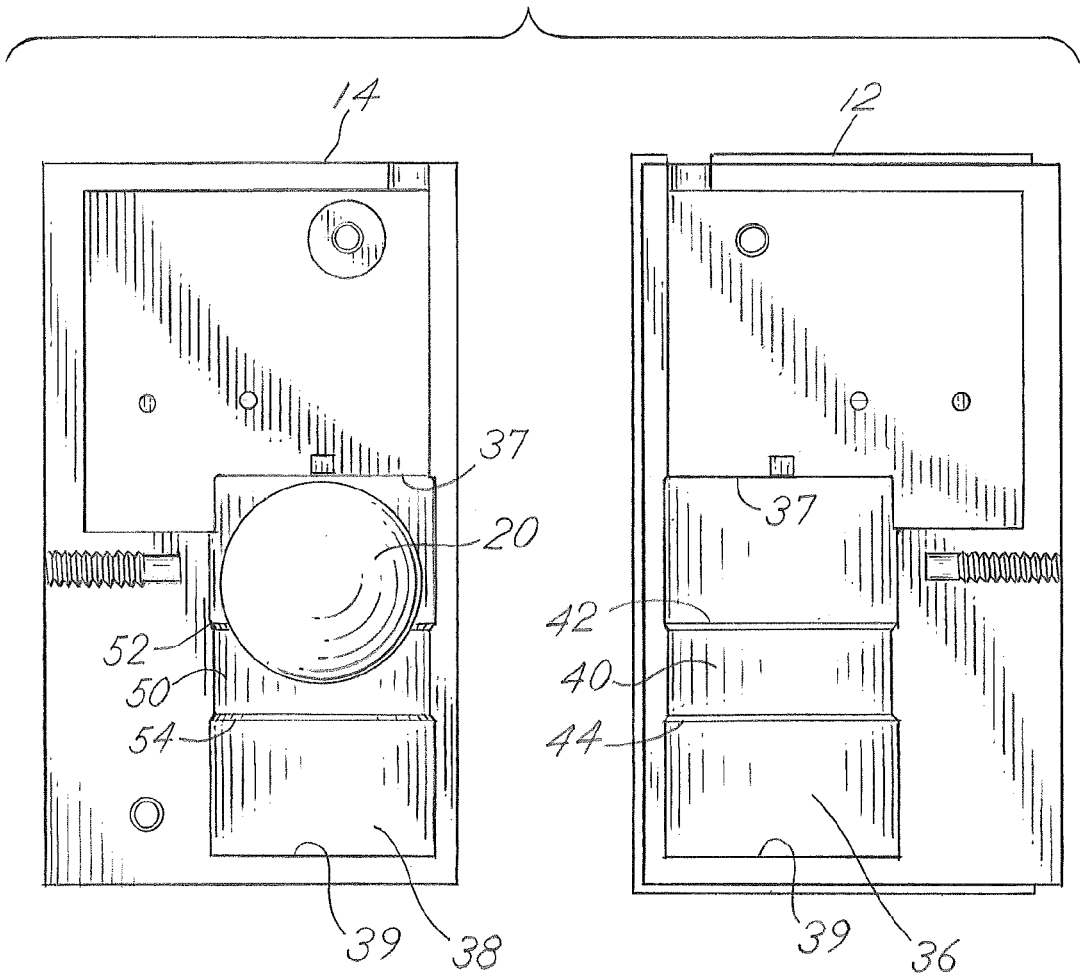
FIG. 3 is an inside front view of the first and second housing sections of the movement detecting device and switch.

An embodiment of a movement detecting device and switch 10 is shown in FIG. 1. The movement detecting device and switch 10 has a first section 12 with an exterior lip 13 and a second section 14, which also has an exterior lip 15. In one embodiment, the housing sections 12, 14 are held together by at least one fastener 16. In the preferred embodiment, the housing sections 12, 14 are held together by two screws 16, as shown in FIG. 2. The movement detecting device and switch 10 is attached to a mounting apparatus, such as the damper arm 30 shown in FIGS. 1 and 2, by way of fastener 32 and washer 34. In turn, the damper arm 30 may be attached to a desired mechanical device for building automation, such as a rotational shaft of an air control device which is shown diagrammatically as 33. In one embodiment, the damper arm 30 includes a slot 31.

The first section 12 includes a half-cylinder section 36 which accepts at least a portion of a ball 20. The section 36 has opposite end walls 37, 39 and a raised portion 40, which includes edges 42, 44. The second section 14 also includes a half-cylinder section 38 which also accepts at least a portion of the ball 20. The section 38 also has a raised portion 50 which includes edges 52, 54. When the housing sections 12, 14 are joined together, the interior cavity 100 is formed. Intuitively, the cavity 100 has a circular cross section. Additionally, when the first and second housing sections 12, 14 are brought together, the exterior lips 13, 15 come together and snugly reside within the slot 31 of the damper arm 30. The housing sections 12, 14 at the side opposite of the cavity 100 are securely fastened together as a result.

The ball 20 may be formed from metal, rubber or plastic, and in a preferred embodiment, the ball 20 measures between 0.5 and 1.0 inches and weighs between 16.0 and 30.0 grams. In a more preferred embodiment, the ball 20 is formed from steel and measures between 0.625 and 0.75 inches and weighs between 16.0 and 29.0 grams.

A switch 22 with a lever arm 23 is placed between sections 12 and 14 so as to extend over half-cylinder sections 36 and 38 when sections 12 and 14 are fitted together. The switch 22 is attached to wire bundle 18 which contains a plurality of wires 24, 26, and 28, which allow for the switch 22 to provide electrical signals to a controller 29 at a location to be utilized for control of the device 33 to which the movement detecting device and switch 10 may be attached.

In operation, the movement detecting device and switch 10 is assembled with the ball 20 placed between sections 12, 14 within the half-cylinder sections 36, 38. The damper arm 30, or similar device, is attached and the movement detecting device and switch 10 is placed on a building automation device to detect movement thereof. In one configuration, the movement detecting device and switch 10 is attached to a building automation device at an angle positioning the ball 20 in sections 36, 38 adjacent to edges 44, 54. When the building automation device moves or is caused to move, the ball 20 will be positioned against edges 44, 54 until the angle of movement of the building automation device exceeds a specified angle. At that occurrence, the ball 20 breaches the edges 44, 54 and proceeds to a position adjacent to edges 42, 52. In this position, the ball 20 contacts the arm 23 of the switch 22 and the appropriate action occurs: an electrical signal is sent through wire bundle 18 or an electrical signal already passing through wire bundle 18 is broken. If the angle of movement of the building automation device drops below the specified angle, the ball 20 will be positioned against edges 42, 52 and breach those edges to proceed again to the position adjacent edges 44, 54.

While the invention has been illustrated and described in detail in the drawings and foregoing description, the same is to be considered illustrative and not restrictive in character. It is understood that the embodiments have been shown and described in the foregoing specification in satisfaction of the best mode and enablement requirements. It is understood that one of ordinary skill in the art could readily make a nearly infinite number of insubstantial changes and modifications to the above-described embodiments and that it would be impractical to attempt to describe all such embodiment variations in the present specification. Accordingly, it is understood that all changes and modifications that come within the spirit of the invention are desired to be protected.

What is claimed is:

1. A movement detecting device comprising:

a first housing section having a half-cylinder section with a raised portion, said raised portion includes edges;

a second housing section also having a half-cylinder section with a raised portion, said raised portion includes edges;

a ball disposed between the first and second housing sections against said edges within a cavity; and a switch disposed between the first and second housing sections, wherein the switch extends into the cavity for contact with the ball when said ball breaches said edges in response to movement of said device.

2. The movement detecting device of claim 1, wherein the device includes a mounting apparatus.

3. The movement detecting device according to claim 1, wherein the switch includes a lever arm that extends from the switch into said cavity.

4. The movement detecting device according to claim 1, wherein the ball is formed from steel and has a diameter measuring between 0.5 and 1.0 inches and weighs between 16 and 29 grams.

5. A movement detecting device comprising:

a first housing section;

a second housing section;

a ball disposed between the first and second housing sections within a cavity;

a switch disposed between the first and second housing sections, wherein the switch extends into the cavity for contact with the ball; and a mounting apparatus, the mounting apparatus includes a damper arm having a slot, said first and second housing sections each having an exterior lip, said lips residing in said slot when the first and second housing sections are secured together by at least one fastener.

6. A movement detecting device comprising:

an insulated housing having a cavity, said cavity having a circular cross section, opposite end walls and an interior wall extending between the end walls, said interior wall having a raised portion defined by edges;

a ball disposed in said cavity suitable for rolling from one of the end walls over the raised portion and to the other end wall when movement of said housing exceeds a predetermined angle;

a switch secured in the housing, said switch includes a lever arm that extends into the cavity for making contact with the ball so that the ball depresses the lever arm when the ball rolls to the other end wall upon said housing exceeding said predetermined angle; and wire electrically connecting the switch and a controller for controlling a mechanical device as desired.

7. The movement detecting device according to claim 6, wherein said housing comprises a first half section with a half-cylinder section and a second half section also having a half-cylinder section, said first and second half sections being held together by at least one fastener.

8. A movement detecting device according to claim 7, wherein the device includes a mounting apparatus, said mounting apparatus further comprising a damper arm having a slot in which resides a first exterior lip portion of the first housing section and a second exterior lip portion of the second housing section when the first and second housing sections are secured together.

9. The movement detecting device according to claim 6, wherein the ball is formed from steel and has a diameter measuring between 0.5 and 1.0 inches and a weight of between 16 and 29 grams.

10. A movement detecting device according to claim 6, wherein the device includes a mounting apparatus.

11. The movement detecting device of claim 10, wherein the ball is formed from steel and has a diameter measuring 0.75 inches and a weight of between 28 and 29 grams.

* * * * *